US007052006B2

(12) United States Patent
Stauber et al.

(10) Patent No.: US 7,052,006 B2
(45) Date of Patent: May 30, 2006

(54) PROCESS AND APPARATUS FOR PRODUCING STACKS OF PRINTED PRODUCTS PROVIDED WITH AN ADDITIONAL SHEET

(75) Inventors: H. Ulrich Stauber, Grüt (CH); Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 45 days.

(21) Appl. No.: 10/755,951

(22) Filed: Jan. 13, 2004

(65) Prior Publication Data

US 2004/0139694 A1 Jul. 22, 2004

(30) Foreign Application Priority Data

Jan. 14, 2003 (CH) ..... 0052/03

(51) Int. Cl.
*B65H 33/04* (2006.01)

(52) U.S. Cl. ..... 270/58.31; 271/189; 414/789.5; 414/789.9; 414/790.1

(58) Field of Classification Search ..... 270/58.31, 270/58.32; 271/189; 414/789.5, 789.9, 414/791, 791.1, 791.2
See application file for complete search history.

(56) References Cited

U.S. PATENT DOCUMENTS 2,382,998 A * 8/1945 Kleinschmidt ..... 270/58.31
RE23,641 E * 4/1953 Andren ..... 270/58.32
4,183,704 A * 1/1980 Steinhart ..... 414/788.3
4,214,743 A * 7/1980 Meier ..... 271/182
4,565,130 A 1/1986 Leu
4,577,852 A * 3/1986 Grunder ..... 271/188
4,983,096 A * 1/1991 Bodewein ..... 414/789.5
5,370,382 A * 12/1994 Wetter ..... 271/183
5,704,604 A * 1/1998 Koelle et al. ..... 270/52.09
6,085,487 A 7/2000 De Vlaam
6,241,233 B1 6/2001 DeVlaam
6,446,962 B1 * 9/2002 Taffertshofer ..... 271/312

FOREIGN PATENT DOCUMENTS

EP 0 894 721 A1 2/1999
WO WO 00/34127 A1 6/2000
WO WO 2000034127 A1 * 6/2000

* cited by examiner

*Primary Examiner*—Patrick Mackey
(74) *Attorney, Agent, or Firm*—Alston & Bird LLP

(57) ABSTRACT

A method and apparatus for producing stacks of flat objects, such as printed products 28, wherein the printed products are fed to a preliminary stacking compartment 20, into which opens the outlet 32 of an arrangement 12 for feeding additional sheets 14. Located beneath the preliminary stacking compartment is a final compartment 36, which can be rotated through 180° about a vertical axis of rotation 38 in order to be able to receive from the preliminary stacking compartment 20 sub-stacks 34 which have been rotated in relation to one another. Each sub-stack 34 may be formed on an additional sheet 14 in the preliminary stacking means 18, as a result of which, in the complete stack 54, the sub-stacks 34, each forming a layer, are separated from one another by an additional sheet 14.

9 Claims, 2 Drawing Sheets

PROCESS AND APPARATUS FOR PRODUCING STACKS OF PRINTED PRODUCTS PROVIDED WITH AN ADDITIONAL SHEET

BACKGROUND OF THE INVENTION

The present invention relates to a process and to an apparatus for producing stacks of printed products provided with an additional sheet. A process and an apparatus of this general type are known, for example, from CH-A-667 065 and the corresponding U.S. Pat. No. 4,565,130.

In the prior apparatus, a compartment is located beneath a preliminary stacking compartment, in which the printed products, which are fed from above, are stacked to form preliminary stacks. The preliminary stacks, after having been rotated through 180° in each case, are discharged in a state in which they have been rotated in relation to one another. The cover sheets, which are prepared in an arrangement for supplying loose and printed cover sheets, are introduced into the compartment by means of a cover-sheet conveyor, with the result that in each case one printed cover sheet ends up located on the complete stack or beneath the stack which is to be built up in the compartment.

EP-A-0 968 947 and the corresponding U.S. Pat. No. 6,241,233 disclose an arrangement in which, at the same time as a complete stack is ejected out of the compartment, a cover sheet on which the next stack ends up located is drawn into the compartment.

In the case of a process which is known from EP-A0 894 721, and of a corresponding arrangement, the complete stack, comprising sub-stacks which are set down one upon the other in a state in which they have been rotated through 180°, is ejected out of the compartment in each case with the aid of a slide and fed to a printer and delivery means, with the aid of which the stack is provided with a cover sheet. Once again with the aid of a slide, the stack provided with a cover sheet is conveyed into a strapping position and strapped.

A further process and a further arrangement for the protective wrapping of stacks of printed products are known from WO-A-00/34127. Stacks of printed products which each have an edge distinguished by an increased thickness are wrapped such that those stack sides in which the distinguished edges are arranged are completely covered by the wrapper and thus protected to good effect. Since the above mentioned stacks are not particularly stable in a direction transverse to the distinguished edges, the stacks are ejected, parallel to the distinguished edges, out of a stacking compartment, in which they are formed, directly between the forms of a pair of forks. The stack is pressed between the forks, and the pair of forks, together with the pressed stack, is guided through a curtain of wrapping material. The wrapping material is then closed around the pair of forks and around the stack, and the wrapped stack, once the wrapper has been provided, is separated from the pair of forks, by the latter and the stack moving relative to one another, and conveyed away. A pressing fork may be equipped with a movable compartment for a cover sheet, which is to be supplied in the ejecting position to a stack, or for applying another flat product. In the case of the wrapped stack and pair of forks being separated, the compartment with the pair of forks is drawn out of the wrapper and the cover sheet remains on the stack.

EP-A-0 586 802 and the corresponding U.S. Pat. No. 5,370,382 disclose an arrangement for forming stacks from folded printed products, in which a preliminary stacking compartment is closed at the bottom by means of slide plates and intermediate base elements can be pushed into the stacking compartment above the slide plates, the fed printed products being set down one upon the other on said intermediate base elements at the beginning of a sub-stack forming operation. As soon as a certain number of printed products have been stacked, the intermediate base elements are drawn out of the stacking compartment, as a result of which the stacked printed products drop onto the slide plates and the sub-stack is finished by virtue of further printed products being fed. The finished sub-stack is then set down on a raisable and lowerable compartment base by virtue of the slide plates being moved apart from one another.

According to the known processes, and using the known apparatuses, the recipient specific number of printed products are stacked to form a complete stack and provided with a cover sheet, and then wrapped in sheet material or tied by means of a band. If a number of recipients are to be supplied one after the other with a relatively small number of printed products, the complete stacks with the correspondingly small number of printed products are put together, stacked one upon the other and once again wrapped or bound for transportation and handling purposes. This requires arrangements for storing the complete stacks on an intermediate basis, setting them down one upon the other and wrapping or binding them.

The object of the present invention is thus to improve the known process and the apparatus of the described type such that the additional arrangements mentioned above can be dispensed with.

SUMMARY OF THE INVENTION

The above and other objects and advantages of the invention are achieved by the provision of a method and apparatus wherein the printed products are serially fed from above into a preliminary stacking compartment which is bounded at the bottom by a compartment base. The base is sequentially closed and opened so that a series of sub-stacks are formed in the preliminary stacking compartment and individually dropped into a final compartment which is located below the preliminary stacking compartment.

According to the invention, an additional sheet is arranged between two adjacent sub-stacks. This additional sheet, for separating sub-stacks located one upon the other, may be a separating sheet, for example a colored sheet with or without printing. This is achieved, in a preferred manner, by in each case one additional sheet being introduced into the preliminary stacking compartment in which the printed products are stacked to form the sub-stacks. Since it is no longer necessary here for each recipient specific complete stack to be individually wrapped, bound or strapped, a long cycle time is available for packaging, i.e. wrapping, binding or strapping the complete stacks and transporting them away.

BRIEF DESCRIPTION OF THE DRAWINGS

The process according to the invention and the apparatus according to the invention will be described in more detail with reference to an exemplary embodiment illustrated in the drawings, in which, purely schematically.

DETAILED DESCRIPTION OF THE PREFERRED EMBODIMENT

Figure 1:
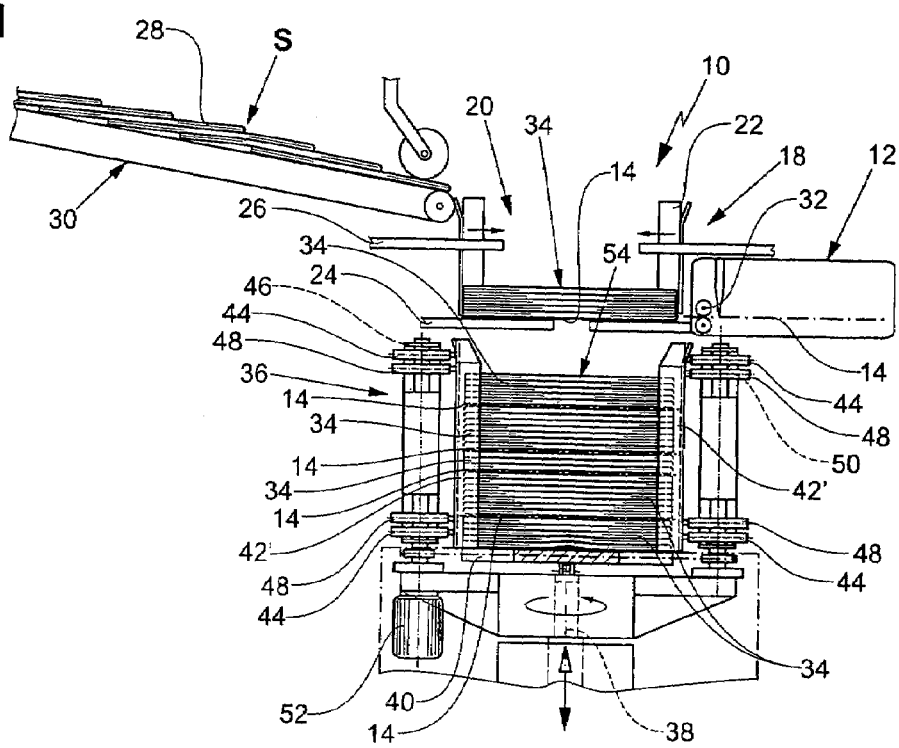
FIG. 1 is a side view elevation view showing an apparatus according to the invention for stacking printed products.

The apparatus shown in the figures has a stacking arrangement 10, an arrangement 12 for feeding additional sheets 14 and a strapping station 16, which directly follows the stacking arrangement 10. In the example shown, the arrangement 12 for feeding the additional sheets 14 may be designed, at the same time, for supplying and for printing the additional sheets 14.

The stacking arrangement 10 and, in particular, the specific design of the final compartment 36 as described below, are disclosed and described in the Swiss patent application 2003 0051/03, filed 14 Jan. 2003, and which corresponds to the concurrently filed U.S. application Ser. No. 10/755,895, which was published Jul. 22, 2004 as U.S. Patent Application Publication No. 2004/0140607 A1, entitled "Apparatus for Forming Stacks of Flat Objects". With respect to the construction and functioning of the stacking arrangement 10, the reader is expressly referred to these patent applications, which are expressly incorporated by reference.

The stacking arrangement 10 has a preliminary stacking means 18, which includes a preliminary stacking compartment 20 which is bounded on all four sides by a compartment base which is composed of guide brackets 22 and at the bottom by a preliminary compartment base which is composed of two slide plates 24, which can be moved into the preliminary stacking compartment 20 and moved out of the same. At a distance above the slide plates 24, for example fork-like intermediate base elements 26 can be moved into the preliminary stacking compartment 20 and moved out of the same again. The construction and the functioning of this preliminary stacking means 18 and the interaction thereof with a rotatable compartment arranged therebeneath are known from EP-A-0 586 802 and the corresponding US Pat. No. 5,370,382, which are expressly incorporated herein by reference.

The preliminary stacking means 18 can be fed printed products 28, in the present case folded newspapers, in imbricated formation by means of a feed conveyor 30 designed as a belt conveyor, such that the preliminary stacking compartment 20 is charged from above.

Furthermore, the preliminary stacking means 18 is assigned the arrangement 12 for feeding the additional sheets 14 such that the outlet 32, which has a pair of conveying rollers for the cover sheets 14, opens into the side of the preliminary stacking compartment 20 adjacent the bottom thereof, directly above the slide plates 24. In FIG. 1, a printed additional sheet 14, or so-called cover sheet, rests on the slide plates 24 which have been moved into the preliminary stacking compartment 20. A sub-stack 34 comprising a certain number of, in the present case five, printed products 28 is located on the additional sheet. As is indicated by arrows, the intermediate base elements 26 are moved into the preliminary stacking compartment 20 in order for the next printed products 28 which are fed by means of the feed conveyor 30 to be stacked thereon until the sub-stack 34 has been discharged from the preliminary stacking compartment 20 by virtue of the slide plates 24 being moved out. The slide plates 24 are moved into the preliminary stacking compartment 20 again and, if appropriate, a new additional sheet 14 for the next sub-stack 34 can be introduced into the preliminary stacking compartment 20.

Beneath the preliminary stacking means 18, the stacking arrangement 10 comprises a final compartment 36 which can be rotated about a vertical central axis of rotation 38. The final compartment 36 has a compartment base 40 which can be raised and lowered by means of a corresponding drive. After a sub-stack 34 has been received in each case, the compartment 36 can be rotated through 180° about the axis of rotation 38, with the result that the sub-stacks 34 which are set down one upon the other in this compartment have been rotated through 180° in each case relative to one another.

In order to reduce the dropping height of the sub-stacks 34 when the slide plates 24 are drawn out of the preliminary stacking compartment 20, and thus to achieve a high stacking quality, the compartment base 40 in each case is raised until it or the uppermost printed product of the printed products 28 stacked thereon is located at a small distance beneath the slide plates 24. When the compartment base 40 is subsequently lowered, the slide plates 24 are moved into the preliminary stacking compartment 20 again as soon as the entire sub-stack 34 discharged is located in the final compartment 36.

In the illustrated embodiment, a complete stack 54 comprising five sub-stacks 34 is located in the compartment 36, in each case one additional sheet 14 being arranged between the sub-stacks 34. These additional sheets 14 are preferably color separating sheets, possibly without any printing. By virtue of the separating sheets, the separation of the sub-stacks 34 can be seen to particularly good effect.

The compartment 36 is bounded at its four corners by in each case one vertically extending angle bracket 42, 42'. The angle brackets which are arranged at the upstream end of the compartment 36, as seen in an ejecting direction A, are designated 42 and the angle brackets which are arranged at the downstream end are designated 42'. The angle brackets 42 are each fastened on a top and on a bottom endless chain 44, which is guided around corresponding chain wheels 46 at the upstream end and at the downstream end of the compartment 36, as seen in the ejecting direction A. Correspondingly, the angle profiles 42' are each arranged on a further top and a further bottom chain 48, these being guided around further chain wheels 50 which are mounted equiaxially with the chain wheel 46. By means of a drive motor 52, the mutually opposite angle brackets 42 can be moved synchronously by simultaneous driving of the corresponding chains 44, the drive motor 52 being connected via a reversing gear mechanism to the chains 44 arranged on the other side of the compartment 36. In a corresponding manner, the angle profiles 42' can be driven synchronously by means of a further drive motor (not shown).

Figure 2:
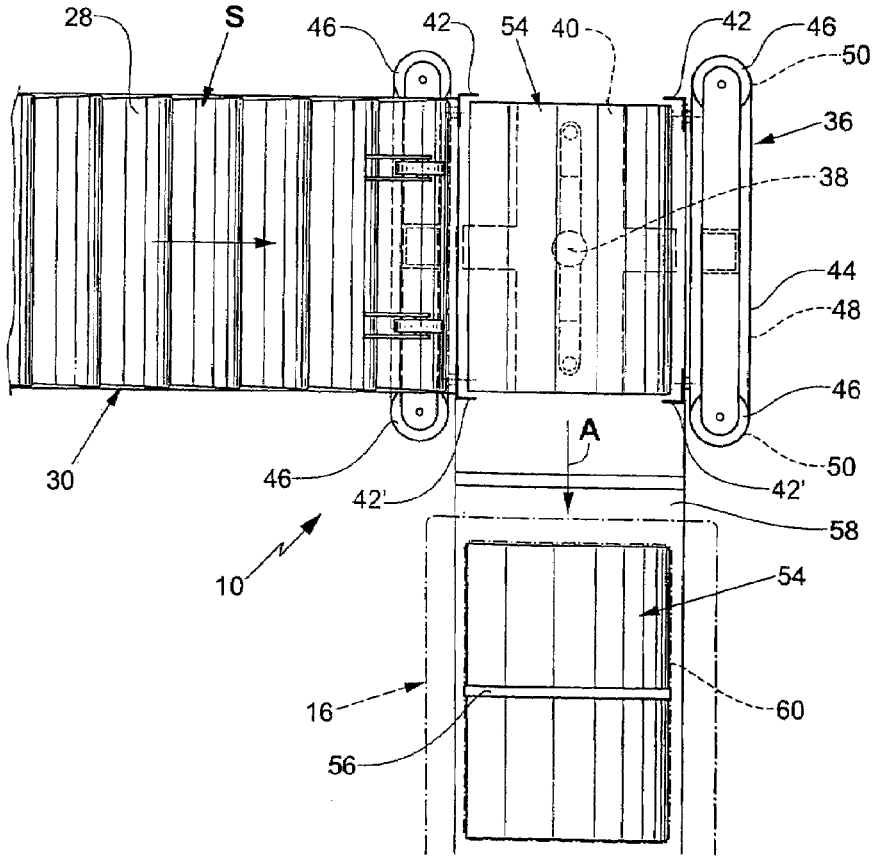
FIG. 2 is a top plan view of the apparatus shown in FIG. 1 with a strapping station following it.

In FIGS. 1 and 2, the angle brackets 42, 42' have been displaced, by means of the drive motors 52, into a position in which they bound the compartment 36 such that a gap is present between them and the printed products 28 which are to be stacked and those which have already been stacked, in order to allow raising and lowering by means of the compartment base 40 without the printed products 28 arranged thereon being damaged. However the angle brackets 42, 42' are located in such a position that the printed products 28 cannot slide out of the compartment 36 at all.

For rotation of the compartment 36, the angle brackets 42, 42' arranged on the two sides of the compartment 36 are moved toward one another in each case by means of the drive motors 52 until they butt against the stacked printed products 28. This allows very quick rotation of the compartment 36 without there being any risk of printed products 28 present in the compartment 36 being shifted out of place or twisted.

In order to eject a complete stack 54 out of the compartment 36 in the ejecting direction A and, at the same time, to feed it to the strapping station 16, first of all the further angle brackets 42', or the latter together with the angle brackets 42, are moved in the ejecting direction A, as a result of which, on the one hand, the angle brackets 42' move out of the movement path of the complete stack 54, around the associated further chain wheels 50, into the region of the outer, return strand of the further chains 48 and, on the other hand, the angle brackets 42 eject the complete stack 54 from the compartment 36. As soon as the ejecting operation has been completed, the angle brackets 42 and 42' are displaced back, by means of the drive motors 52, into the position shown in FIGS. 1 and 2 again.

Figure 3:
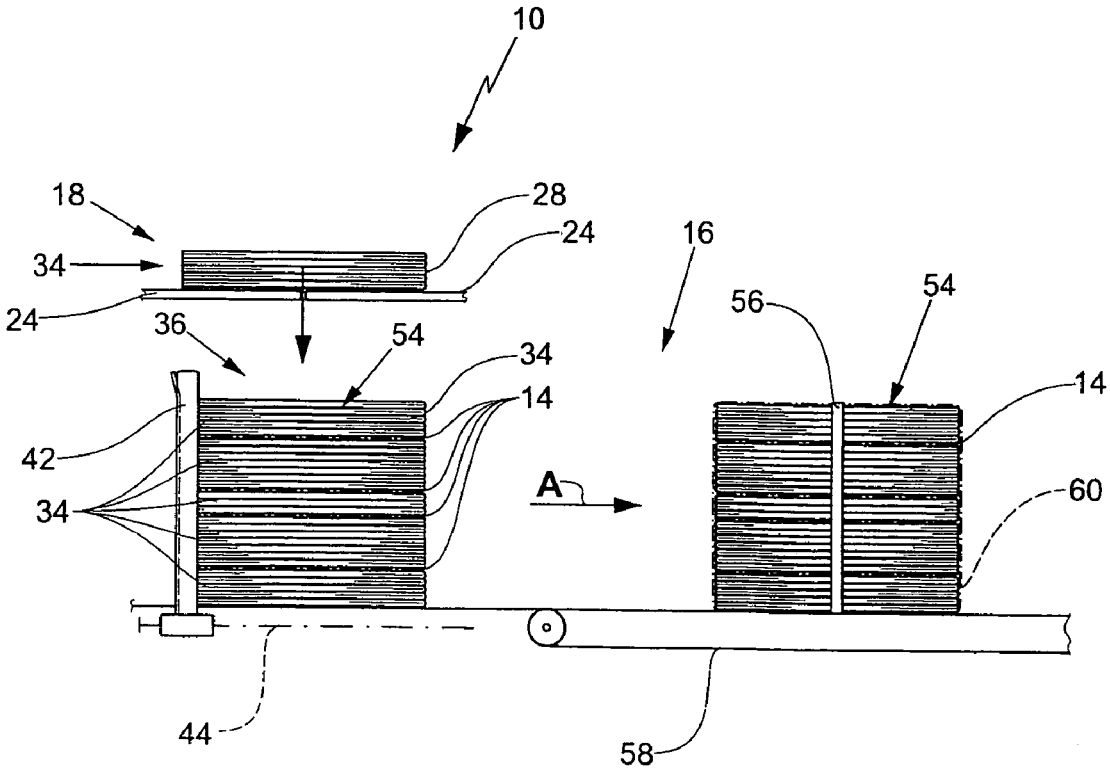
FIG. 3 is a schematic side elevation view, showing the apparatus with a strapping station according to FIG. 2.

FIG. 3 shows a complete stack 54, formed in the compartment 36, during-the operation of ejecting it in the ejecting direction A by means of the angle brackets 42. The angle brackets 42', which are not illustrated here, are located outside the movement path of the complete stack 54, in the region of the return strand corresponding further chains 48. A previously formed, ejected complete stack 54 has been strapped in the strapping station 16 by means of a band 56 and is located, in order to be transported away, on a removal conveyor 58 designed as a belt conveyor. As is indicated by chain-dotted lines, it is possible, in the strapping station 16, for the complete stack 54 to be wrapped in a known manner in a sheet material 60 before being strapped by a band 56. In this case, the strapping station 16 is designed as a wrapping and strapping station or a wrapping station is arranged upstream of the strapping station 16, the complete stack 54, coming from the stacking arrangement 10, being fed first of all to said wrapping station. Arrangements which are suitable for this purpose are known from the prior art.

For the sake of completeness, it should be mentioned that the compartment base 40 of the final compartment 36 is of cross-shaped design, as can be gathered from FIGS. 1 and 2. On the one hand, this makes it possible to stack printed products 28 with the format which is smaller than the length of the compartment base 40, as measured in the ejecting direction A, since the brackets 42 and 42' can move past the arms of the compartment base 40 which run in the ejecting direction A. At the same time, however, the stability for the stacked printed products 28 is ensured by the arms of the compartment base 40 which run at right angles to the ejecting direction A. On the other hand, the operation of ejecting a complete stack 54 can begin even as the compartment base 40 is being lowered into its bottom end position.

A complete stack with the sub-stacks 34, each forming a layer, separated from one another by in each case one additional sheet 14 is formed in the compartment 36 at the point in time which is shown in FIGS. 1 and 2. The complete stack 54 is ejected out of the compartment 36 in ejecting direction A and fed to the strapping station 16, for the initial sub-stack 34 of the next complete stack 54 which is to be formed has already been formed in the preliminary stacking means 18. This sub-stack 34 rests on an additional or cover sheet 14, which has been fed into the preliminary stacking compartment 20 through the outlet 32. The intermediate base elements 26 are moved into the preliminary stacking compartment 20 in order for the next following printed products 28 supplied by means of the feed conveyor 30 to be stacked thereon.

As soon as the complete stack 54 has been ejected out of the compartment 36, the compartment base 40 is raised to beneath the slide plates 24, whereupon the latter are drawn out of the preliminary stacking compartment 20 and the sub-stack 34 located thereon, with the additional sheet 14, ends up located on the compartment base 40. Once the slide plates 24 have been moved in, a new additional or separating sheet 14 is fed and the intermediate base elements 26 are then moved out of the preliminary stacking compartment 20 in order to complete the sub-stack 34, located on the additional sheet 14, on the slide plates 24. During this time, the compartment 36 is rotated through 180° about the axis of rotation 38 and the compartment base 40 is raised to such an extent that the uppermost product of the sub-stack 34 resting thereon is located at a small distance beneath the slide plates 24, in order then to receive the next sub-stack when the slide plates 24 are drawn out of the preliminary stacking compartment 20. It is also the case here that the lowermost sub-stack 34 of the future complete stack 54 has an additional or cover sheet 14. The sub-stacks 34 are separated from one another by means of a separating sheet and have the appropriate number of printed products 28.

It is also possible, if a recipient is assigned a large number of printed products 28, to arrange, between a cover sheet and a separating sheet or on a separating sheet, two or more sub-stacks 34 which are not separated by a further additional sheet 14, but are set down one upon the other in a state in which they have been offset through 180° in relation to one another.

Since the arrangement 12 for feeding and, if appropriate, supplying and printing the additional sheets 14 is assigned to the preliminary stacking means 18, a high processing capacity is achieved, all the more so if the preliminary stacking means 18 is provided with intermediate base elements 26.

An arrangement for feeding, supplying and printing cover sheets may be designed, for example, such that a paper web drawn off from a supplier roll is printed and a section is severed from the latter in each case by means of a cutting device during the operation of feeding into the preliminary stacking compartment. It is, of course, also conceivable for additional sheets to be drawn also from a magazine, for these to be printed, if appropriate, and then introduced into the preliminary stacking compartment 20. In order to allow a high processing capacity, each stacking arrangement 10 is preferably assigned a dedicated arrangement 12 for feeding and, if appropriate, supplying and printing the additional sheets 14.

The feed conveyor 30 may also be a clamp-type transporter, in the case of which each printed product 28 is retained by a clamp which is fed to the preliminary stacking compartment 20, as is known, for example, from CH-A-667 065 and the corresponding U.S. Pat. No. 4,565,130, and from DE-A-27 52 513 or DE-A-31 30 945.

For the sake of completeness, it should be mentioned that the outlet 32 of the arrangement 12 for feeding the additional sheets 14 can also open out into the preliminary stacking compartment 20 at a relatively large distance above the slide plates 24, so that the cover sheets 14 each end up located on the sub-stack 34. However, it is preferable, as is shown in FIG. 1, for the outlet 32 to be located in the vicinity of the slide plates 24.

The final compartment 36 may also be designed as is known from the prior art. The compartment 36 need not necessarily be capable of rotation about its axis.

It is also possible for complete stacks 54 to be ejected counter to the ejecting direction A. For this purpose, a removal conveyor is arranged on that side of the stacking arrangement 10 which is directed away from the strapping station 16.

A rotatable compartment 36 is or is not rotated, as required, prior to a further sub-stack 34 being received. It is thus possible for additional sheets 14 to be arranged between sub-stacks 34 which are oriented in the same direction.

All the functions of the apparatus are controlled by a control means (not shown).

The invention claimed is:

1. A method for producing stacks of printed products provided with an additional sheet between sub-stacks thereof, comprising the steps of serially feeding printed products from a feed conveyor into a preliminary stacking compartment which is bounded at the bottom by a compartment base, and so that the printed products enter the preliminary stacking compartment from above the compartment, sequentially closing and opening the compartment base so that a series of sub-stacks are formed in the preliminary stacking compartment and individually dropped into a final compartment which is located below the preliminary stacking compartment, feeding at least one additional sheet, which is visually distinct from the printed products, after at least one sub-stack has been formed in the preliminary stacking compartment and before a further sub-stack is dropped upon the one sub-stack in the final compartment so that the additional sheet ends up located between the one sub-stack and the further sub-stack, and wherein the feeding step comprises feeding the additional sheet laterally into the preliminary stacking compartment through a side of the compartment and at a location immediately above the compartment base so that the further sub-stack is formed upon the additional sheet.

2. The method of claim 1 comprising the further step of rotating the final compartment by about 180° about a central vertical axis between the dropping of the one sub-stack and the further sub-stack thereinto and so that the one and further sub-stacks are disposed in a relationship rotated about 180° with respect to each other.

3. The method of claim 1 wherein the additional sheet is fed after the one sub-stack has been formed and dropped into the final compartment and before the further sub-stack has been formed.

4. The method of claim 1 comprising the further step of feeding another additional sheet into the preliminary stacking compartment before the one sub-stack is formed so that the one sub-stack ends up located on the another additional sheet.

5. An apparatus for producing stacks of printed products provided with an additional sheet between sub-stacks thereof, comprising a feed conveyor, a preliminary stacking compartment positioned with respect to the feed conveyor so that the preliminary stacking compartment is serially supplied with printed products from above the preliminary stacking compartment, and with the preliminary stacking compartment being bounded at the bottom by a compartment base which is mounted for movement between a closed position wherein the fed products may be stacked to form a sub-stack, and a withdrawn position, a final compartment positioned below the preliminary stacking compartment into which the sub-stacks are sequentially dropped when the compartment base of the preliminary stacking compartment is moved from its closed position to its withdrawn position, to form a complete stack, and an arrangement for feeding an additional sheet, which is visually distinct from the printed products, after at least one sub-stack has been formed and before a further sub-stack is dropped onto the already formed sub-stack in the final compartment, and such that the additional sheet ends up located between these two sub-stacks in the final compartment, and wherein the arrangement for feeding an additional sheet has an outlet which is positioned to deliver the sheets into the preliminary stacking compartment through a side thereof and immediately above the compartment base.

6. The apparatus of claim 5 wherein the final compartment is mounted for rotation about a central vertical axis and the apparatus further comprises a rotation drive for selectively rotating the final compartment about said axis by about 180° so that sub-stacks can be dropped one upon another in a relationship rotated about 180° in relation to one another.

7. The apparatus of claim 5 wherein the portion of the preliminary stacking compartment above the outlet includes an intermediate base which is mounted for movement into and out of the preliminary stacking compartment and on which the printed products may be stacked until the relevant additional sheet is introduced into the preliminary stacking compartment.

8. The apparatus of claim 5 wherein the arrangement for feeding an additional sheet is programmed to feed an additional sheet before the one sub-stack is formed.

9. The apparatus of claim 5 wherein the apparatus further comprises a strapping and/or wrapping station which is positioned to receive complete stacks from the final compartment.

* * * * *